US008711131B2

(12) United States Patent
Kwag et al.

(10) Patent No.: US 8,711,131 B2
(45) Date of Patent: Apr. 29, 2014

(54) SWITCHING MODULE AND SWITCHING SYNCHRONIZATION SYSTEM

(75) Inventors: Heui Sam Kwag, Suwon-si (KR); Sang Kyeong Yun, Suwon-si (KR); Chang Seob Kim, Seoul (KR); Jung Hwan Park, Busan (KR); Ho Chan Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 431 days.

(21) Appl. No.: 13/074,605

(22) Filed: Mar. 29, 2011

(65) Prior Publication Data

US 2011/0234555 A1 Sep. 29, 2011

(30) Foreign Application Priority Data

Mar. 29, 2010 (KR) ..... 10-2010-0028033

(51) Int. Cl.
*G09G 5/00* (2006.01)

(52) U.S. Cl.
USPC ..... 345/204; 362/85; 362/227

(58) Field of Classification Search
USPC ..... 345/76, 82, 204; 362/3, 85, 227; 340/426.13, 426.14, 426.15
See application file for complete search history.

(56) References Cited

U.S. PATENT DOCUMENTS 5,329,431 A * 7/1994 Taylor et al. ..... 362/85
5,769,527 A * 6/1998 Taylor et al. ..... 362/85
5,815,068 A * 9/1998 Vadseth ..... 340/332
5,969,306 A 10/1999 Velauthapillai et al.
7,178,941 B2 * 2/2007 Roberge et al. ..... 362/225
2005/0049726 A1 * 3/2005 Adamson et al. ..... 700/19
2006/0002110 A1 * 1/2006 Dowling et al. ..... 362/252
2006/0284734 A1 * 12/2006 Newman, Jr. ..... 340/825
2007/0188427 A1 * 8/2007 Lys et al. ..... 345/82
2007/0241928 A1 * 10/2007 Hardwick et al. ..... 340/825.72

FOREIGN PATENT DOCUMENTS

KR 10-2001-0073647 A 8/2001
KR 10-0636855 B1 10/2006
KR 10-2009-0076874 A 7/2009

OTHER PUBLICATIONS

Korean Office Action issued on Apr. 20, 2011 in the corresponding Korean Patent Application No. 10-2010-0028033.

* cited by examiner

*Primary Examiner* — Tom Sheng
(74) *Attorney, Agent, or Firm* — Sughrue Mion, PLLC

(57) ABSTRACT

There are provided a switching module and a switching synchronization system. The switching module includes a plurality of first to n-th switching modules according to an exemplary embodiment of the present invention, wherein each of the first to n-th switching modules includes: a button unit that includes a plurality of switching buttons; a state display unit that includes a plurality of display lamps corresponding to each of the plurality of switching buttons in the button unit; a switch controller that controls the operation of the state display unit according to the operation of each of the plurality of switching buttons in the button unit; and a switch communication unit that transmits the wireless switching control signal including the switching control and provides the switching control signals included in the wireless switching control signals received to the switch controller.

9 Claims, 5 Drawing Sheets

SWITCHING MODULE AND SWITCHING SYNCHRONIZATION SYSTEM

CROSS-REFERENCE TO RELATED APPLICATIONS

This application claims the priority of Korean Patent Application No. 2010-28033 filed on Mar. 29, 2010, in the Korean Intellectual Property Office, the disclosure of which is incorporated herein by reference.

BACKGROUND OF THE INVENTION

1. Field of the Invention

The present invention relates to a switching module and a switching synchronization system that can be applied to a lighting lamp system, and more particularly, to a switching module and a switching synchronization system capable of synchronizing operational status indications for switching buttons performing the same functions among a plurality of switching modules, in the plurality of switching modules having the switching buttons in order to operate a plurality of lamps in a specific space.

2. Description of the Related Art

Generally, many lamps have been used in a relatively open space such as an auditorium, a classroom, a seminar room, and so on of a school. In order to conveniently operate many lamps in the wide space, switch boxes including a plurality of switching buttons have been installed in several locations such as the front and back of the auditorium, and so on.

However, when the plurality of switch boxes are installed in several locations, a user may not accurately know which of the plurality of switching buttons in each of the plurality of switching boxes can operate lamps located at a certain location and may not know the turned-on/off state of a lamp currently being used. In this case, in order to operate the lamps desired by a user, he/she randomly operates the switching buttons.

However, when the plurality of switch boxes are used to operate the lamps in a specific space, it is impossible to identify the lamp locations corresponding to the plurality of switching buttons in each switch box and to confirm the operational state of each of the corresponding lamps, thereby leading to problems in that may be difficult to operate the plurality of lamps, and so on.

SUMMARY OF THE INVENTION

An aspect of the present invention provides a switching module and a switching synchronization system capable of synchronizing operational status indications for switching buttons performing the same functions among a plurality of switching modules, in the plurality of switching modules having the switching buttons in order to operate a plurality of lamps in a specific space.

According to an aspect of the present invention, there is provided a switching module including a plurality of first to n-th switching modules, wherein each of the first to n-th switching modules includes: a button unit that includes a plurality of switching buttons capable of operating lamps for each of a plurality of zones in which a plurality of lamps are previously divided for each region; a state display unit that includes a plurality of display lamps corresponding to each of the plurality of switching buttons in the button unit, each of the plurality of display lamp displaying the operational state of the corresponding switching buttons; a switch controller that controls the operation of the state display unit according to the operation of each of the plurality of switching buttons in the button unit, generates the switching control signals including the operational information on each of the plurality of switching buttons to control the transmission of the switching control signals, and controls the operation of the state display unit according to the operational information included in the received switching control signals; and a switch communication unit that generates the wireless switching control signals according to a predetermined applicable communications protocol and transmits the wireless switching control signal including the switching control signals generated from the switch controller and provides the switching control signals included in the wireless switching control signals received according to the applicable communications protocol to the switch controller.

According to an aspect of the present invention, there is provided a switching synchronization system, including: a lamp part that includes a plurality of first to n-th lamp modules, each of the plurality of first to n-th lamp modules including a lamp unit that includes a plurality of lamps included in a predetermined corresponding zone and a control circuit unit that controls the operation of a plurality of lamps in the lamp unit according to received wireless switching control signals; and a switch part that includes a plurality of first to n-th switching modules capable of operating lamps for each of a plurality of zones of the lamp part, each of the first to n-th switching modules including operational information on the plurality of switching buttons, transmitting and receiving wireless switching control signals according to a predetermined applicable communications protocol, and performing switching synchronization according to the operational information.

Each of the first to n-th switching modules includes: a button unit that includes a plurality of switching buttons capable of operating lamps for each of a plurality of zones in which a plurality of lamps are previously divided for each region; a state display unit that includes a plurality of display lamps corresponding to each of the plurality of switching buttons in the button unit, each of the plurality of display lamp displaying the operational state of the corresponding switching buttons; a switch controller that controls the operation of the state display unit according to the operation of each of the plurality of switching buttons in the button unit, generates the switching control signals including the operational information on each of the plurality of switching buttons to control the transmission of the switching control signals, and controls the operation of the state display unit according to the operational information included in the received switching control signals; and a switch communication unit that generates the wireless switching control signals according to a predetermined applicable communications protocol and transmits the wireless switching control signal including the switching control signals generated from the switch controller and provides the switching control signals included in the wireless switching control signals received according to the applicable communications protocol to the switch controller.

Further, the button unit includes: a plurality of zone buttons corresponding to each of the plurality of zones; a program button corresponding to the plurality of predetermined zones; and a plurality of functional buttons corresponding to each of the plurality of functions.

The state display unit includes: a plurality of zone display lamps corresponding to the plurality of zone buttons; program display lamps corresponding to the program buttons; and a plurality of function display lamps corresponding to the plurality of functional buttons.

The wireless switching control signal includes operational information that has the number of zones, zone number, and state information related to an on/off state of a lamp and a lamp brightness state.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
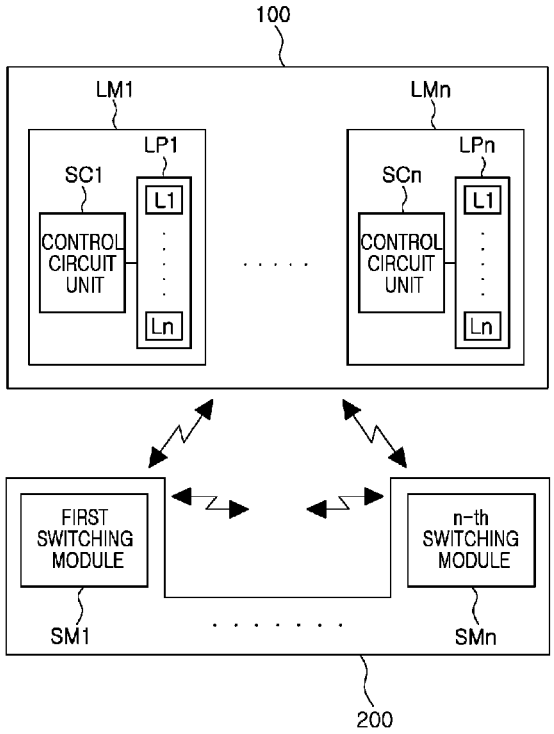
FIG. 1 is a block diagram of a switching synchronization system according to the present invention.

Exemplary embodiments of the present invention will now be described in detail with reference to the accompanying drawings.

The present invention should not be construed as being limited to the embodiments set forth herein and the embodiments set forth herein may be used to assist in understanding the technical idea of the present invention. Like reference numerals designate like components having substantially the same constitution and function in the drawings of the present invention.

FIG. 1 is a block diagram of a switching synchronization system according to the present invention. Referring to FIG. 1, a switching synchronization system according to the present invention includes a lamp part 100 that includes a plurality of first to n-th lamp modules LM1 to LMn. Each of the first to n-th lamp modules LM1 to LMn includes lamp units LP1 to LPn including a plurality of lamps included in a predetermined corresponding zone and control circuit units SC1 to SCn controlling an operation of a plurality of lamps in the lamp unit according to received wireless switching control signals.

In addition, the switching synchronization system according to the present invention includes a switch part 200 including a plurality of first to n-th switching modules SM1 to SMn that can operate lamps for each zone in the lamp part 100, wherein each of the first to n-th switching modules SM1 to SMn includes operational information for a plurality of switching buttons, transmits and receives the wireless switching control signals according to a predetermined applicable communication protocol, and performs switching synchronization according to the operational information.

Figure 2:
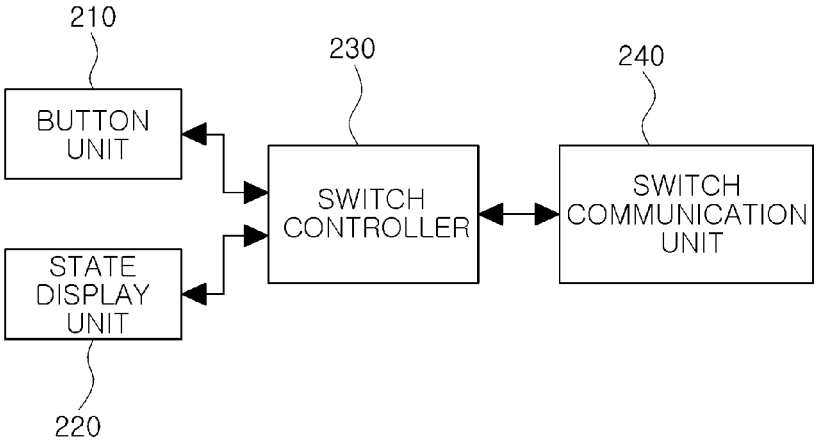
FIG. 2 is a block diagram of a switching module according to the present invention.

FIG. 2 is a block diagram of a switching module according to the present invention. Referring to FIG. 2, a switching module according to the present invention may be configured to include the plurality of first to n-th switching modules SM1 to SMn. Each of the first to n-th switching modules SM1 to SMn includes a button unit 210 that includes the plurality of switching buttons capable of operating lamps for each of the plurality of zones in which the plurality of lamps have been previously divided for each region.

Each of the first to n-th switching modules SM1 to SMn includes a plurality of display lamps corresponding to each of the plurality of switching buttons in the button unit 210 and each of the plurality of display lamps includes a state display unit 220 that displays the operational state of the corresponding switching buttons.

Each of the first to n-th switching modules SM1 to SMn includes a switch controller 230 that controls the operation of the state display unit 220 according to the operation of each of the plurality of switching buttons in the button units, generates the switching control signals including operational information regarding each of the plurality of switching buttons to control the transmission of the switching control signals, and controls the operation of the state display unit 220 according to the operational information included in the received switching control signals.

Each of the first to n-th switching modules SM1 to SMn includes a switch communication unit 240 that generates the wireless switching control signals according to the predetermined applicable communications protocol and transmits the wireless switching control signals including the switching control signals generated from the switch controller 230, and provides the switching control signals included in the wireless switching control signals received according to the applicable communications protocol to the switch controller 230.

Figure 3:
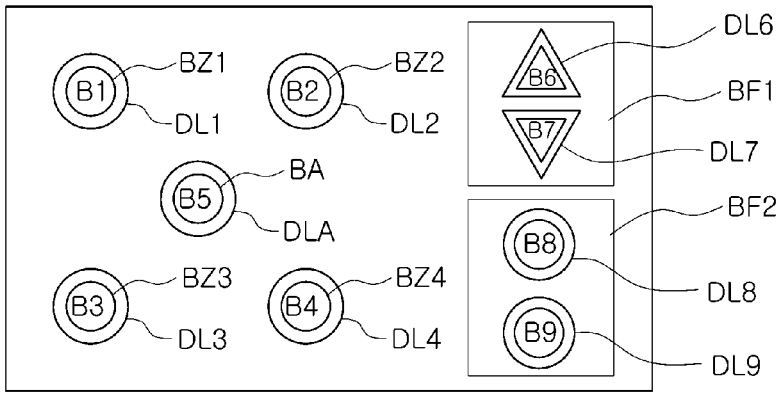
FIG. 3 is a diagram showing one implementation example of a button unit and a state display unit according to the present invention.

FIG. 3 is a diagram showing one implementation example of a button unit and a state display unit according to the present invention. Referring to FIG. 3, the button unit 210 may include a plurality of zone buttons BZ1 to BZ4 corresponding to each of the plurality of zones, a program button BA corresponding to the plurality of predetermined zones, and a plurality of functional buttons BF1 and BF2 corresponding to each of a plurality of functions. The plurality of functional buttons BF1 and BF2 may be set to control the dimming of lamps in a specific zone or of lamps in all the zones. When color lamps are used, they can be set to produce colors from the color lamps, and so on, and may be set and used in various manners according to applied locations and applied lamps.

The state display unit 220 may include a plurality of zone display lamps DZ1 to DZ4 corresponding to the plurality of zone buttons BZ1 to BZ4, a program display lamp DLA corresponding to the program button BA, and a plurality of function display lamps DL6 to DL9 corresponding to the plurality of functional buttons BF1 and BF2.

Figure 4:
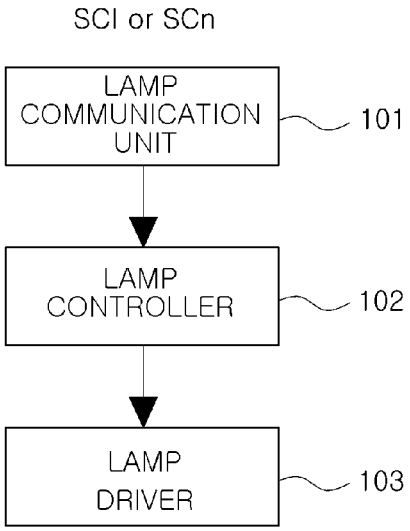
FIG. 4 is a diagram showing one implementation example of a lamp unit according to the present invention.

FIG. 4 is a diagram showing one implementation example of a lamp unit according to the present invention. Referring to FIG. 4, when the button unit 210 shown in FIG. 3 includes four zone buttons, that is, the first to fourth zone buttons BZ1 to BZ4 and the lamp units LP1 to LPn may be configured to include four zone lamp units, that is, the first to fourth zone lamp units LP1 to LP4.

Figure 5:
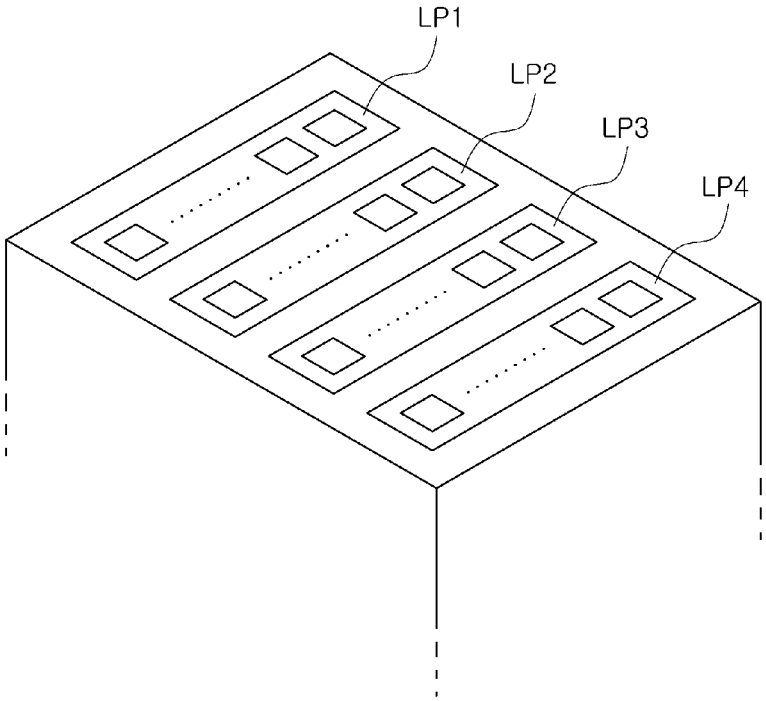
FIG. 5 is a block diagram of a control circuit unit according to the present invention.

FIG. 5 is a block diagram of a control circuit unit according to the present invention. Referring to FIG. 5, each of the control circuit units SC1 to SCn may include a lamp communication unit 101 confirming whether zone numbers of control signals included in the wireless switching control signals received from the switching part 200 match preset zone numbers of the wireless control signals and if it is determined that the zone numbers match each other, a lamp controller 102 that controls the lamp operation according to the state information on the control signals, and a lamp driver 103 that drives the plurality of lamps installed in the corresponding zones according to the control of the lamp controller 102.

Meanwhile, the wireless switching control signal may include the operational information that includes the number of zones (n), zone number (#No.), and state information related to an on/off state of a lamp and a lamp brightness state.

As an example, when the lamp is operated to be turned-on in the case of zone number 1, the wireless switching control signal may include the number of the zone (1), the zone number (#1), and the on state information.

As another example, when all the lamps are operated to be turned-on in the case of predetermined three zone numbers 1, 2, and 3, the wireless switching control signal may include the number of zones (3), the zone number (#1), the on state information, the zone number (#2), the on state information, the zone number (#3), and the on state information.

Figure 6:
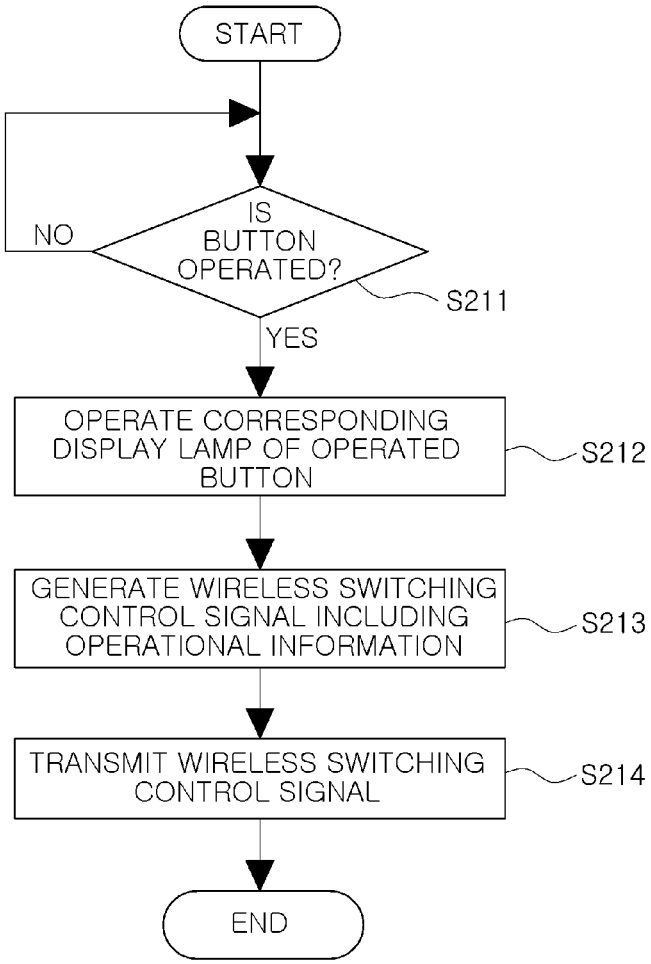
FIG. 6 is a flow chart of a transmitting operation of a switching module according to the present invention.

FIG. 6 is a flow chart of a transmitting operation of a switching module according to the present invention. Referring to FIG. 6, step S211 is a step that determines whether the switching controller included in the switching module according to the present invention operates the buttons in the button unit. Step S212 is a step that operates the corresponding display lamps using the operated buttons when the button is operated. Step S213 is a step that generates the wireless switching control signals including the operational information for the operated buttons according to the predetermined applicable communications protocol. Step S214 is a step that transmits the generated wireless switching control signals from the switching communication unit of the switching module according to the present invention.

Figure 7:
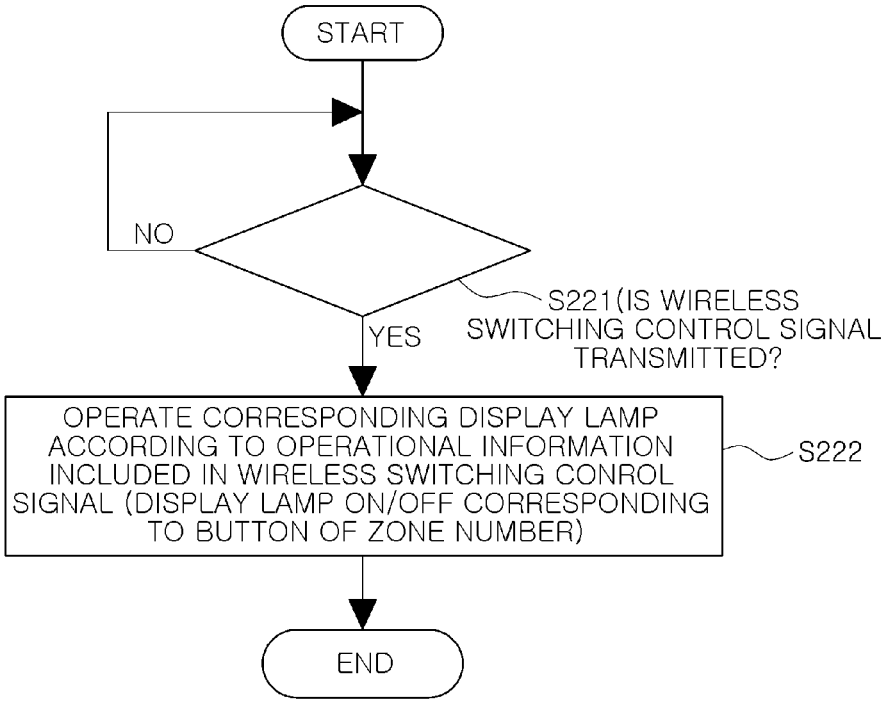
FIG. 7 is a flow chart of a receiving operation of a switching module according to the present invention.

FIG. 7 is a flow chart of a receiving operation of a switching module according to the present invention. Referring to FIG. 7, step S221 is a step that determines whether the switching controller included in the switching module according to the present invention receives the wireless switching control signals. Step S222 is a step that operates the corresponding display lamps according to the operational information included in the wireless switching control signals when the wireless switching control signals are received.

Hereinafter, the operations and effects of the present invention will be described in detail with reference to the accompanying drawings.

The switching synchronization system and the switching module according to the present invention will be described with reference to FIGS. 1 to 7.

Describing the switching synchronization system according to the present invention with reference to FIG. 1, the switching synchronization system according to the present invention may be configured to include the lamp part 100 and the switch part 200.

First, the lamp part 100 may include the plurality of first to n-th lamp modules LM1 to LMn, wherein each of the first to n-th lamp modules LM1 to LMn may includes the lamp units LP1 to LPn and the control circuit units SC1 to SCn.

For example, the first lamp module LM1 may include the first lamp unit LP1 and the first control circuit unit SC1 and the n-th lamp module LMn may include the n-th lamp unit LPn and the n-th control circuit unit SCn.

In this case, each of the first to n-th lamp units LP1 to LPn may include the plurality of lamps included in each of the predetermined corresponding first to n-th zones.

Each of the first to n-th control circuit units SC1 to SCn may control the operation of the plurality of lamps included in the corresponding lamp units among the first to n-th lamp units LP1 to LPn according to the received wireless switching control signals.

For example, the first control circuit unit SC1 turns-on the plurality of lamps included in the first lamp unit LP1 when the operational information included in the wireless switching control signals is turned-on and the n-th control circuit unit SCn may turn-off the plurality of lamps included in the n-th lamp unit LPn when the operational information included in the wireless switching control signals is turned-off.

The operational information may include the number of zones (n), the zone number (#No.), and the state information related to the on/off state of the lamp and the lamp brightness state.

For example, when the lamp is operated to be turned-on in the case of zone number 1, the operational information may include the number of the zone (1), the zone number (#1), and the on state information. As another example, when all the lamps are operated to be turned-on in the case of predetermined three zone numbers 1, 2, and 3, the operational information may include the number of zones (3), the zone number (#1), the on state information, the zone number (#2), the on state information, the zone number (#3), and the on state information.

Next, the switch part 200 includes the plurality of first to n-th switching modules SM1 to SMn that can operate lamps for each of the plurality of zones of the lamp part 100 and each of the first to n-th switching modules SM1 to SMn includes the operational information for the plurality of switching buttons, transmits and receives the wireless switching control signals according to the predetermined communications protocol, and performs switching synchronization according to the operational information.

Describing the switching module according to the present invention with reference to FIGS. 1 and 2, the switching module according to the present invention may be configured to include the plurality of first to n-th switching modules SM1 to SMn.

Each of the first to n-th switching modules SM1 to SMn may be configured to include the button unit 210, the switch control unit 230, and the switch communication unit 240.

First, each of the first to n-th switching modules SM1 to SMn can operate lamps for each of the plurality of zones in which the plurality of lamps have been previously divided for each region through the plurality of switching buttons included in the button unit 210.

The switch controller 230 controls the operation of the state display unit 220 according to the operation of each of the plurality of switching buttons in the button unit 210.

In this case, the state display unit 220 includes the plurality of display lamps corresponding to each of the plurality of switching buttons in the button unit 210 according to the control of the switching controller 230 to display the operational state of the switching buttons corresponding to each of the plurality of display lamps.

Next, the switch controller 230 generates the switching control signals including the operational information on each of the plurality of switching buttons to control the transmission of the switching control signals.

The switch communication unit 240 generates the wireless switching control signals according to the predetermined applicable communications protocol and transmits the wireless switching control signals including the switching control signals generated from the switch controller 230. Further, the switch communication unit 240 provides the switching control signals included in the wireless switching control signals received according to the applicable communications protocol to the switch controller 230.

Therefore, the switch controller 230 controls the operation of the state display unit 220 according to the operational information included in the received switching control signals.

Referring to FIG. 3, the button unit 210 may include the plurality of zone buttons BZ1 to BZ4 corresponding to each of the plurality of zones, the program button BA corresponding to the plurality of predetermined zones, and the plurality of functional buttons BF1 and BF2 corresponding to each of a plurality of functions.

According to the structure of the button unit 210, the state display unit 220 may include the plurality of zone display lamps DZ1 to DZ4 corresponding to the plurality of zone buttons BZ1 to BZ4, the program display lamp DLA corresponding to the program button BA, and the plurality of function display lamps DL6 to DL9 corresponding to the plurality of functional buttons BF1 and BF2.

Describing one implementation example of the lamp unit according to the present invention with reference to FIG. 4, when the button unit 210 shown in FIG. 3 includes four zone buttons, that is, the first to fourth zone buttons BZ1 to BZ4, the lamp units LP1 to LPn may be configured to include four zone lamp units, that is, the first to fourth zone lamp units LP1 to LP4.

For example, when the first zone button BZ1 is operated to be turned-on through the button unit 210, the first zone display lamp DL1 of the state display unit 220 displays the on state of the first zone button BZ1 according to the control of the switching controller 230. In this case, the switching controller 230 generates the switching control signals having the operational information including the number of zones (1), the zone number (#1), and the on state information to generate and transmit the wireless switching control signals through the switching communication unit 240.

As another example, if the program button BA is operated to be turned-on through the button unit 210, the program display lamp DLA of the state display unit 220 displays the on state of the program display lamp (BA) according to the control of the switching controller 230 when the program button BA is set to have the three zone numbers 1, 2, and 3. In this case, the switching controller 230 generates the switching control signals having the operational information including the number of zones (3), the zone number (#1), and the on state, the zone number (#2) and the on state, and the zone number (#3) and the on state information to generate and transmit the wireless switching control signals through the switching communication unit 240.

Describing the control circuit unit according to the present invention with reference to FIG. 5, each of the first to n-th control circuit units SC1 to SCn may be configured to include the lamp communication unit 101, the lamp controller 102, and the lamp driver 103.

In this case, the lamp communication unit 101 may confirm whether the zone numbers of the control signals included in the wireless switching control signals received from the switching part 200 match the zone numbers of the control signal to the preset zone numbers of the wireless switching control signals.

In addition, the lamp controller 102 may control the lamp operation according to the state information on the control signals when the zone numbers match each other.

The lamp driver 103 may drive the plurality of lamps installed in the corresponding zones according to the control of the lamp controller 102.

For example, when the lamp units LP1 to LPn are configured to include the four zone lamp units, that is, the first to fourth zone lamp units LP1 to LP4, the control circuit unit is also configured to include the four zone lamp units, that is, the first to fourth control circuit units SC1 to SC4 corresponding to each of the first to fourth zone lamp units LP1 to LP4.

Describing the transmitting operation of the switching module according to the present invention with reference to FIG. 6, the switching controller 230 included in each of the switching modules according to the present invention determines whether the buttons in the button unit 210 are operated in FIG. 6 (S211). When the buttons are operated, the corresponding display lamp of the state display unit 220 is operated according to the control of the switching controller 230 (S212). Further, according to the control of the switching controller 230, the switching communication unit 240 generates the wireless switching control signals including the operational information on the operated buttons according to the predetermined applicable communications protocol (S213). It transmits the generated wireless switching control signals from the switching communication unit of the switching module according to the present invention (S214).

Describing the receiving operation of the switching module according to the present invention with reference to FIG. 7, the switching controller 230 included in each of the switching modules according to the present invention determines whether the wireless switching control signals are received in FIG. 7 (S221). When the wireless switching control signals are received through the switch communication unit 240, the switch controller 230 operates the corresponding display lamps through the state display unit 220 according to the operational information included in the received wireless switching control signals (S222).

As described above, the present invention can synchronize the operational status indications for the switching button performing the same functions among the plurality of switching modules, in the plurality of switching modules having the plurality of switching buttons in order to operate the plurality of lamps in the specific space.

Therefore, the present invention can immediately confirm the state of the lamps and conveniently perform the operation of the lamps.

As set forth above, according to exemplary embodiments of the present invention, it can synchronize the operational status indications for the switching buttons performing the same functions among the plurality of switching modules, in the plurality of switching modules having the switching buttons in order to operate the plurality of lamps in a specific space, thereby making it possible to immediately confirm the state of the lamps and conveniently perform the operation of the lamps.

While the present invention has been shown and described in connection with the exemplary embodiments, it will be apparent to those skilled in the art that modifications and variations can be made without departing from the spirit and scope of the invention as defined by the appended claims.

What is claimed is:

1. A switching module including a plurality of first to n-th switching modules, wherein each of the first to n-th switching modules includes:

a button unit including a plurality of switching buttons capable of operating lamps for each of a plurality of zones in which a plurality of lamps are previously divided for each region;

a state display unit including a plurality of display lamps corresponding to each of the plurality of switching buttons in the button unit, each of the plurality of display lamps displaying an operational state of the corresponding switching buttons;

a switch controller configured to control an operation of the state display unit according to an operation of each of the plurality of switching buttons in the button unit, generate switching control signals including operational information on each of the plurality of switching buttons to control transmission of the switching control signals, and control the operation of the state display unit according to the operational information included in received switching control signals; and a switch communication unit configured to generate wireless switching control signals according to a predetermined applicable communications protocol, transmit the wireless switching control signals including the switching control signals generated from the switch controller, and provide the switching control signals included in the wireless switching control signals received according to the applicable communications protocol to the switch controller.

2. The switching module of claim 1, wherein the button unit includes:

a plurality of zone buttons corresponding to each of the plurality of zones;

program buttons corresponding to the plurality of predetermined zones; and a plurality of functional buttons corresponding to each of the plurality of functions.

3. The switching module of claim 2, wherein the state display unit includes:

a plurality of zone display lamps corresponding to the plurality of zone buttons;

program display lamps corresponding to the program buttons; and a plurality of function display lamps corresponding to the plurality of functional buttons.

4. The switching module of claim 1, wherein the wireless switching control signal includes information that has at least one of a number of zones, a zone number, and state information related to an on/off state of a lamp and a lamp brightness.

5. A switching synchronization system, comprising:

a lamp part including a plurality of first to n-th lamp modules, each of the plurality of first to n-th lamp modules including a lamp unit that includes a plurality of lamps included in a predetermined corresponding zone and a control circuit unit that controls an operation of a plurality of lamps in the lamp unit according to received wireless switching control signals; and a switch part including a plurality of first to n-th switching modules capable of operating lamps for each of a plurality of zones of the lamp part, each of the first to n-th switching modules configured to transmit and receive wireless switching control signals including operational information of a plurality of switching buttons according to a predetermined applicable communications protocol, and perform switching synchronization according to the operational information, wherein each of the first to n-th switching modules includes a state display unit including a plurality of display lamps in a one to one correspondence with each of the plurality of switching buttons, each of the plurality of display lamps providing notification that a corresponding switching button is selected.

6. A switching synchronization system, comprising:

a lamp part including a plurality of first to n-th lamp modules, each of the plurality of first to n-th lamp modules including a lamp unit that includes a plurality of lamps included in a predetermined corresponding zone and a control circuit unit that controls an operation of a plurality of lamps in the lamp unit according to received wireless switching control signals; and a switch part including a plurality of first to n-th switching modules capable of operating lamps for each of a plurality of zones of the lamp part, each of the first to n-th switching modules configured to transmit and receive wireless switching control signals including operational information of a plurality of switching buttons according to a predetermined applicable communications protocol, and perform switching synchronization according to the operational information, wherein each of the first to n-th switching modules further includes:

a button unit including the plurality of switching buttons capable of operating lamps for each of a plurality of zones in which a plurality of lamps are previously divided for each region;

a state display unit that includes a plurality of display lamps corresponding to each of the plurality of switching buttons in the button unit, each of the plurality of display lamp displaying the operational state of the corresponding switching buttons;

a switch controller configured to control an operation of the state display unit according to an operation of each of the plurality of switching buttons in the button unit, generate switching control signals including operational information on each of the plurality of switching buttons to control transmission of the switching control signals, and control the operation of the state display unit according to the operational information included in received switching control signals; and a switch communication unit configured to generate the wireless switching control signals according to a predetermined applicable communications protocol, transmit the wireless switching control signals including the switching control signals generated from the switch controller, and provide the switching control signals included in the wireless switching control signals received according to the applicable communications protocol to the switch controller.

7. The switching synchronization system of claim 6, wherein the button unit includes:

a plurality of zone buttons corresponding to each of the plurality of zones;

program buttons corresponding to the plurality of predetermined zones; and a plurality of functional buttons corresponding to each of the plurality of functions.

8. The switching synchronization system of claim 7, wherein the state display unit includes:

a plurality of zone display lamps corresponding to the plurality of zone buttons;

program display lamps corresponding to the program buttons; and a plurality of function display lamps corresponding to the plurality of functional buttons.

9. The switching synchronization system of claim 6, wherein the wireless switching control signal includes information that has at least one of a number of zones, a zone number, and state information related to an on/off state of a lamp and a lamp brightness.

* * * * *